US006793705B2

(12) United States Patent
Kosco

(10) Patent No.: US 6,793,705 B2
(45) Date of Patent: Sep. 21, 2004

(54) POWDER METAL MATERIALS HAVING HIGH TEMPERATURE WEAR AND CORROSION RESISTANCE

(75) Inventor: John C. Kosco, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 0 days.

(21) Appl. No.: 10/000,581

(22) Filed: Oct. 24, 2001

(65) Prior Publication Data

US 2003/0110888 A1 Jun. 19, 2003

(51) Int. Cl.[7] ..... B22F 1/00; B22F 3/12; B22F 3/26

(52) U.S. Cl. ..... 75/231; 75/232; 75/252; 419/10; 419/19; 419/27; 419/28

(58) Field of Search ..... 75/231, 232, 233, 75/234, 255; 419/10, 19, 27, 28

(56) References Cited

U.S. PATENT DOCUMENTS

| | | | | | |
|---|---|---|---|---|---|
| 3,167,427 | A | * | 1/1965 | Slayter | 264/DIG. 25 |
| 3,205,566 | A | * | 9/1965 | Breton | 252/387 |
| 3,624,007 | A | | 11/1971 | Meyer | |
| 3,653,982 | A | | 4/1972 | Prill | 148/31 |
| 3,725,016 | A | | 4/1973 | Mal et al. | 148/31 |
| 3,771,975 | A | | 11/1973 | Frehn | 148/31 |
| 3,782,930 | A | | 1/1974 | Shibata | 148/31 |
| 3,844,800 | A | | 10/1974 | Hooton | |
| 3,891,399 | A | * | 6/1975 | Cadle | 419/10 |
| 3,893,848 | A | * | 7/1975 | Motoyoshi et al. | 148/442 |
| 3,925,065 | A | * | 12/1975 | Osawa et al. | |
| 3,967,935 | A | | 7/1976 | Frehn | 148/31 |
| 4,145,213 | A | | 3/1979 | Oskarsson et al. | 148/31 |
| 4,194,910 | A | | 3/1980 | Mal et al. | 148/31 |
| 4,214,905 | A | | 7/1980 | Sliney | |
| 4,289,833 | A | | 9/1981 | Hachisuka | 148/31 |
| 4,300,951 | A | | 11/1981 | Hachisuka | 148/31 |
| 4,715,892 | A | | 12/1987 | Mahulikar | |
| 4,832,993 | A | | 5/1989 | Coulon | 148/31 |
| 4,853,182 | A | | 8/1989 | Cornie et al. | 148/31 |
| 4,880,460 | A | | 11/1989 | Dulis et al. | 148/31 |
| 4,894,088 | A | | 1/1990 | Yamaguchi et al. | 148/31 |
| 4,973,356 | A | | 11/1990 | von Holst et al. | 148/31 |
| 5,106,576 | A | | 4/1992 | Noda et al. | 148/31 |
| 5,306,568 | A | | 4/1994 | Matsuda et al. | 148/31 |
| 5,358,545 | A | | 10/1994 | Nagro | 148/31 |
| 5,545,249 | A | * | 8/1996 | Tanaka et al. | 75/246 |
| 5,615,406 | A | | 3/1997 | Sasaki et al. | 148/31 |
| 5,679,909 | A | * | 10/1997 | Kaneko et al. | 419/19 |
| 6,110,420 | A | * | 8/2000 | Moorhead et al. | 148/105 |

OTHER PUBLICATIONS

Abubakir, s; Study on the Corrosion and Mechanical Properties of FJ316 Stainless Steel–glass composite, Acta Metallurgica.*

Sand, R.L. et al. Powder Metallurgy Practice and Applications, 1966, London George Newnes Limited. p. 121.*

Kosco, John C., "Powder Metal Materials Including Glass," U.S. patent application Ser. No. 10/144,605, filed May 13, 2002.

* cited by examiner

*Primary Examiner*—Ngoclan T. Mai
(74) *Attorney, Agent, or Firm*—Kirkpatrick & Lockhart LLP

(57) ABSTRACT

A method of forming a powder metal material or article includes the steps of molding a compact from a metallurgical powder, and then sintering the compact. The metallurgical powder may include at least one of a stainless steel powder and a low-chromium steel-base powder, and about 0.5 to about 15 weight percent of glass powder. Alternatively, the metallurgical powder may include at least one of a stainless steel powder and a low-chromium steel-base powder, about 3 to about 15 weight percent molybdenum, and about 1 to about 15 weight percent of nickel-base alloy powder. The present invention also is directed to metallurgical powders useful in and materials and articles made by the methods of the present invention. Such articles include, but are not limited to, valve guides for internal combustion engine EGR systems, valve seats, exhaust system components, combustion chambers, other combustion engine parts subjected to high temperature, and chemical industry valve and corrosion parts.

46 Claims, 6 Drawing Sheets

POWDER METAL MATERIALS HAVING HIGH TEMPERATURE WEAR AND CORROSION RESISTANCE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to materials prepared from metallurgical powders. More particularly, the present invention relates to materials prepared from metallurgical powders and which may exhibit wear, oxidation and corrosion at elevated temperatures.

2. Description of the Invention Background

Exhaust gas recirculation or "EGR" systems are a standard part of the pollution control equipment in automobiles. EGR systems function by re-circulating a controlled amount of high temperature exhaust gas back into the incoming fuel/air mixture. This increases the temperature of the combustion mixture and thereby reduces the amount of undesirable gases emitted to the atmosphere. FIG. 1 illustrates a conventional EGR system generally referred to as 10. The system 10 includes a valve 12, a valve guide 14, and an exhaust gas inlet 16. The inlet 16 opens into intake 18 that communicates with and transfers fresh air to a piston cylinder 20. The amount of exhaust gas that enters the intake 18 and passes to the cylinder 20 with the fresh air is controlled by the opening and closing of the valve 12 by solenoid 22.

EGR systems operate at elevated temperatures, typically 800–1400° F. (427–760° C.), and the valve guide and valve must be made of materials that are resistant to corrosion at high temperatures. These parts also must exhibit some degree of wear resistance. As such, the valve guides have been made from stainless steel-base materials formed by pressing and sintering metallurgical powders. Materials made by press and sinter techniques are generically known as powder metals.

The temperature at which EGR systems operate has been increasing. Initial EGR systems operated at about 800° F. (427° C.). At that temperature, valve guides made of copper-base powder metal alloys containing solid lubricants such as graphite proved satisfactory. More recently, EGR temperatures have been increased to about 1200° F. (649° C.), with long-term plans to increase operating temperatures to the 1500° F. (816° C.) range. At 1000° F. (538° C.) and above, valve guides produced from copper-base materials do not provide satisfactory performance. Instead, certain more costly stainless steel composites have been used. Those composites include stainless steel-Triballoy composites.

Triballoy is a semi-metallic having excellent wear properties and is available from Stellite Corp., Goshen, Ind. It is produced in various forms, including the following alloys (contents shown in weight percentages):

| Alloy | Cobalt | Nickel | Molybdenum | Silicon | Chromium |
|---|---|---|---|---|---|
| Triballoy 100 | 55 | — | 35 | 10 | — |
| Triballoy 400 | 62 | — | 28 | 2 | 8 |

-continued

| Alloy | Cobalt | Nickel | Molybdenum | Silicon | Chromium |
|---|---|---|---|---|---|
| Triballoy 700 | — | 50 | 32 | 3 | 15 |
| Triballoy 800 | 52 | — | 28 | 3 | 17 |

Triballoy shows good wear, corrosion, and oxidation resistance at 1000–1400° F. (538–760° C.). The material, however, is expensive and difficult to machine. Certain known stainless steel-Triballoy powder metal composites used to make EGR system valve guides include MPIF 316L stainless steel powder and about 20% by weight of Triballoy. Although the properties of this composite material make it highly suitable for valve guide applications, a distinct disadvantage is its high cost.

Accordingly, it would be advantageous to provide an economical powder metal material having high temperature corrosion resistance and wear resistance suitable for EGR system valve guide and other applications.

BRIEF SUMMARY OF THE INVENTION

The present invention is directed to a method of forming a powder metal material or article having good high temperature corrosion resistance and wear resistance. The method includes the steps of molding a compact from a metallurgical powder, and then sintering the compact. The metallurgical powder includes at least one of a stainless steel powder and a low-chromium steel-base powder, and also includes about 0.5 to about 15 weight percent of glass powder. Preferably, the sum of the weights of any stainless steel powder and low-chromium steel-base powder in the metallurgical powder is greater than 50 percent of the entire weight of the metallurgical powder. The metallurgical powder may further include about 0.5 to about 15 weight percent, and preferably includes about 3 to about 10 weight percent, molybdenum.

The present invention also is directed to a method of forming a powder metal material or article including the step of molding a compact from a metallurgical powder including at least one of a stainless steel powder and a low-chromium steel-base powder, about 3 to about 15 weight percent molybdenum, and about 1 to about 15 weight percent of nickel-base alloy powder. The compact is sintered in a subsequent step. Preferably, the sum of the weights of stainless steel powder and low-chromium steel-base powder in the metallurgical powder is greater than 50 percent of the entire weight of the metallurgical powder. The nickel-base alloy powder preferably is at least one powder selected from nickel-base brazing powder and nickel-base wear alloy powder.

The sintered compacts produced by the above method of the invention may be subjected to a post-sinter treatment that includes: sizing the sintered compact; impregnating the compact with a suspension including a solid lubricant in a liquid carrier; and then heating the compact to substantially remove the carrier from the compact and provide a deposit of the solid lubricant on the compact. Alternatively, the post-sinter treatment includes: coating and/or impregnating the compact with a suspension including at least one solid lubricant in a liquid carrier; heating the sintered compact to substantially remove the carrier from the compact and provide a deposit of the solid lubricant on the compact; and sizing the compact.

The present invention is further directed to metallurgical powders useful in the methods described herein and to materials and articles made by the methods of the present invention. Such materials include, but are not limited to powder metal materials including a matrix comprising at least one of stainless steel and low-chromium steel, and 0.5 up to 15 weight percent of glass particles suspended in the matrix, wherein the weight percentage is based on the total weight of the material. Articles within the present invention include, but are not limited to, valve guides for internal combustion engine EGR systems, valve seats, exhaust system components, combustion chambers, other combustion engine parts subjected to high temperature (for example, 800–1600° F. (427–871° C.)), and chemical industry valve and corrosion parts produced using the methods of the present invention.

Certain materials within the present invention that the present inventor has evaluated exhibit good corrosion resistance and wear resistance at high temperature. It also is believed that certain materials within the present invention that the present inventor has evaluated may be produced at lower cost than conventional stainless steel/Triballoy material currently used in valve guide applications for combustion engine EGR systems.

The reader will appreciate the foregoing details and advantages of the present invention, as well as others, upon considering the following detailed description of embodiments of the invention. The reader also may comprehend additional advantages and details of the present invention upon carrying out or using the invention.

BRIEF DESCRIPTION OF THE DRAWINGS

The features and advantages of the present invention may be better understood by reference to the accompanying drawing in which.

DETAILED DESCRIPTION OF EMBODIMENTS OF THE INVENTION

Material used in valve guides for EGR systems preferably exhibits the following properties. First, the material must exhibit a coefficient of thermal expansion close to that of the stainless steel valve stem so that clearance between the valve guide and valve stem is maintained at operating temperatures. Second, the material must resist wear from sliding contact with the valve stem at EGR system operating temperatures. Because running a metal against itself usually results in high wear, the material from which the valve guide is constructed preferably is different than the valve stem material. At the same time, thermal expansion properties of both parts should be similar. Third, the material preferably resists corrosion, such as oxidation, in the gaseous environment and at the operating temperatures of the EGR system. In addition to these characteristics, the materials preferably are cost effective and, for example, less costly to produce than conventional 316L-Triballoy composites.

Figure 1:
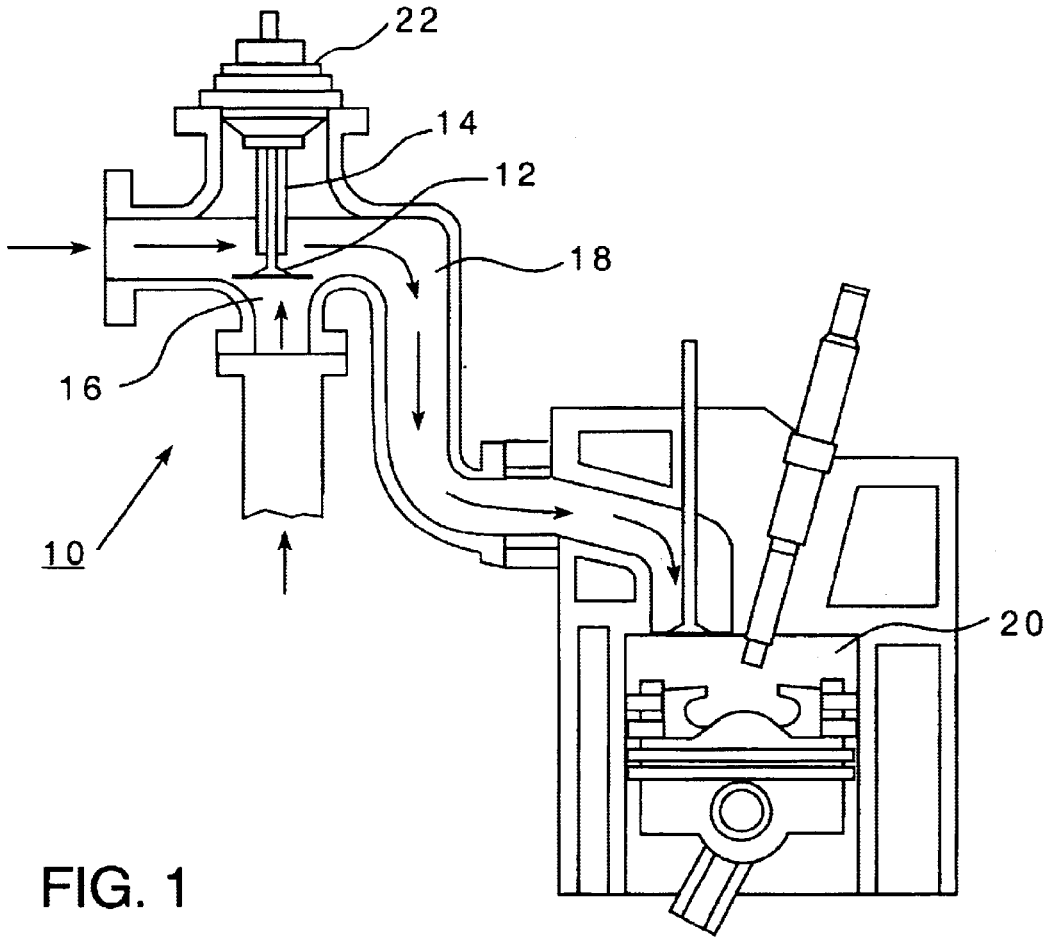
FIG. 1 is a representation of a conventional automobile EGR system.
Figure 2A:
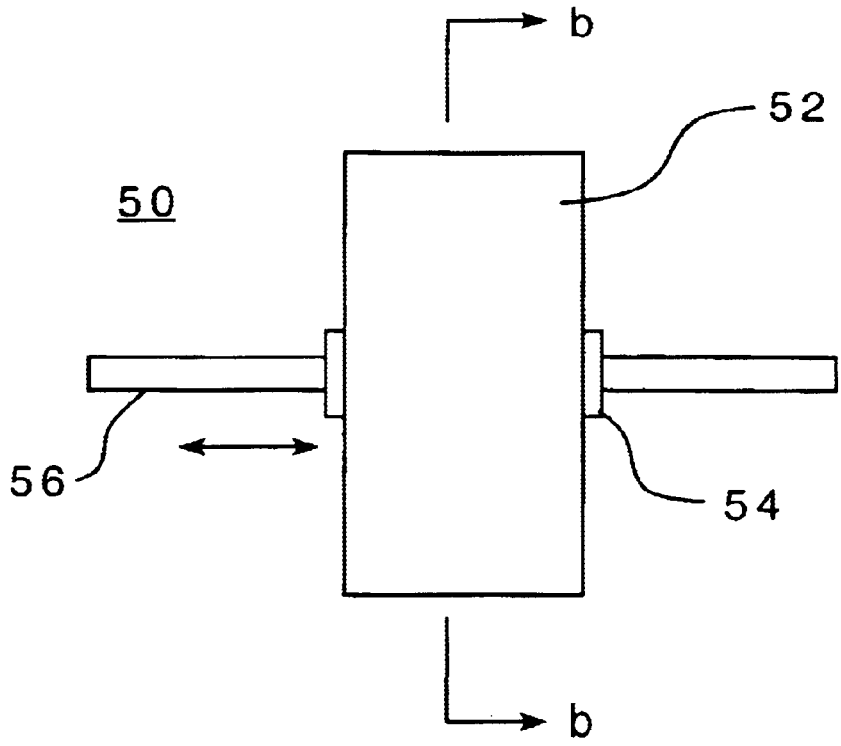
FIGS. 2(*a*) and 2(*b*) are schematic representations of a machine used for testing particular materials within the present invention.
Figure 2B:
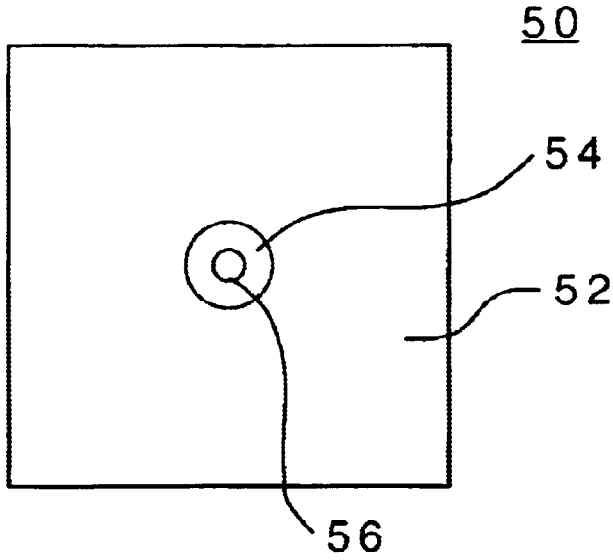

With those preferred objectives in mind, the inventor investigated numerous experimental powder metal materials formed from metallurgical powders. As used herein, "metallurgical powder" refers to material from which powder metal material may be formed by conventional powder metal techniques. A metallurgical powder may include, for example, stainless steel powder and, possibly, other metal-containing and/or metal-free additives such as, for example, particulate alloying ingredients, resinous or other liquid binders, and lubricants. Metallurgical powder also may be referred to herein as a "powder mix". The metallurgical powders were prepared, pressed into the shape of a cylindrical valve guide at pressures of about 20 to about 40 tsi, and sintered. The test shapes were then evaluated using the testing apparatus shown schematically in FIGS. 2(*a*) and 2(*b*) and referenced generally as 50. The testing apparatus 50 included a small furnace 52, which surrounds the valve guide 54 to be tested and a stainless steel rod 56, which is passed through the bore in the valve guide 54. During testing, a rapid linear reciprocal motion is applied to the stainless steel rod 56 while the furnace heats the assembly to about 1200° F. (649° C.). The movement of the stainless steel rod 56 within the valve guide 54 simulates the movement of a valve stem within a valve guide in an internal combustion piston engine.

During testing, the rod was reciprocated within the valve guide at 37,500 cycles per hour for 30 minutes at about 1200° F. (649° C.), the assembly was cooled to less than 200° F. (93° C.), and then the assembly was run for an additional 15 minutes at 37,500 cycles per hour and about 1200° F. (649° C.). For acceptable performance, the rod must show minimal wear as evaluated from surface roughness of the parts after testing. Surface roughness values less than Ra 100 were considered to be acceptable. Ra is the arithmetic average roughness and is expressed throughout the present description of the invention in the units of microinches ($10^{-6}$ inch).

The following three families of powders produced valve guides that exhibited suitable thermal expansion and wear resistance during testing:

Powder including (i.e., not necessarily limited to): (1) at least one of a stainless steel powder and a low-chromium steel-base powder and (2) about 0.5.0–15 weight percent glass.

Powder including (i.e., not necessarily limited to): (1) at least one of a stainless steel powder and a low-chromium steel-base powder, (2) about 0.5 to about 15 weight percent molybdenum powder, and (3) about 0.5 to about 15 weight percent glass.

Powder including (i.e., not necessarily limited to): (1) at least one of a stainless steel powder and a low-chromium steel-base powder, (2) about 0.5 to about 15 weight percent molybdenum powder, (3) about 1 to about 15 weight percent of one or more nickel alloy powders selected from nickel-base brazing alloy powders and nickel-base wear alloy powders, and (4) optionally up to about 15 weight percent glass.

Ingredient (1), which is one or more stainless steel powder and/or low-chromium steel-base powder, is the main component in the above powder families. The sum of the weights of the one or more powders of ingredient (1) is greater than 50 weight percent of the total powder weight. Preferably, ingredient (1) is a single stainless steel powder of the austenitic type. For example, Ingredient (1) may be an MPIF series 300 stainless steel powder such as, for example an MPIF type 316 or 304 stainless steel powder. The inventor has found that 300 series powders, and particularly 316L powders, are preferable for use in EGR system applications for at least the reason that the materials exhibit favorable high temperature corrosion resistance and closely match the thermal expansion properties of common EGR valve stem materials. Producers of 316L and other 300-series stainless steel powders include Ametek Corp., Eighty-four, Pennsylvania. Depending on the composition of the valve stem, other steel alloy powders, such as ferritic and martensitic stainless types, also may be used. For example, MPIF series 400 stainless steel powders, such as, for example, 410L and 430 powders, may be used. Such powders are available from Ametek. Typical compositions of several useful stainless steel powders (amounts shown in weight percentages of the alloy) include the following:

| Stainless Powder | Chromium | Nickel | Molybdenum | Silicon | Others | Iron |
|---|---|---|---|---|---|---|
| 304L | 19 | 12 | — | 0.9 | <2.0 | Bal. |
| 316L | 17 | 13 | 2.2 | 0.8 | <2.0 | Bal. |
| 410L | 12 | — | — | 0.6 | <2.0 | Bal. |

An alternative or adjunct to stainless steel powders included in the powder families is low-chromium steel-base powders. As used herein, low-chromium steel-base powders include about 1.0 up to about 5.0 weight percent chromium. Such powders also preferably include less than 0.1 weight percent carbon, 0 up to 2.0 weight percent molybdenum, and up to a maximum 2.0 weight percent of other additive elements, with the balance being iron. One example of a low-chromium steel-base powder that may be used is a powder available from North American Hoganas, Johnstown, Pa., under the trade name ASTALOY CrM. ASTALOY CrM powder is an alloy including 3 weight percent chromium, 0.5 weight percent molybdenum, and balance iron.

It is believed that powder mixes within the present invention composed predominantly (i.e., more than 50 weight percent) of 400 series stainless steel or low-chromium steel-base powders may not be suitable for conventional EGR system applications because of, for example, a thermal expansion mismatch with conventional valve stem materials. However, such powder mixes may be suitable for other high temperature wear applications and in EGR systems incorporating compatible valve stem materials.

It is contemplated that blends of two or more stainless steel powders and low-chromium steel-base powders may be used as the predominant ingredient in the powder mixes of the present invention. For example, two or more stainless steel powders may be used in combination, or one or more low-chromium steel-base powders may be used alone or in combination with one or more stainless steel powders. A particular example of a stainless steel/low-chromium steel-base powder combination is a blend of 316L stainless steel powder and ASTALOY CrM powder. Because the ASTALOY CrM powder includes only about 3 weight percent chromium, its high temperature corrosion resistance is poorer than 300 or 400 series stainless steel powders, but combinations of stainless and low-chromium steel-base powders may provide suitable corrosion resistance in high temperature applications and may be suitable for other applications.

The above powder families also may include other metal-free or metal-containing additives. For example, the powders may include binders and lubricants. Lubricants may be added to improve a powder's compaction properties. When present, lubricants are preferably included at levels of about 0.35 to about 1.5 weight percent. Adding less than about 0.35 weight percent may result in poor part lubrication, while adding more than about 1.5 weight percent may cause part blistering. Possible lubricants include ethylene bis stearamide (EBS) (available under the trade name ACRAWAX from Lonza Corp., Fairlawn, N.J.) and stearic acid (available from Witco Chemical, Greenwich, Conn.). Other suitable lubricants will be readily apparent to those having ordinary skill in the art.

Binders may be included in the powders to provide adequate "as molded" strength. For example, when glass powder is used in the powders of the present invention, it may be necessary to add one or more binders along with one or more lubricants to permit molding. If binder is present, it preferably is included at levels of about 0.5 to about 3 weight percent. An excess amount of binder may make it difficult to remove the binder from green compacts prior to sintering. Examples of possible binders include acrylic resin, such as, for example, ELVACITE 2010 resin available from DuPont, Wilmington, Del., and polyvinyl alcohol, such as, for example CELVOL from Celanese, Fort Worth, Tex. When binders are utilized, they may be provided, for example, as a solution of the binder that is wet mixed with the powder ingredients. The powder is then dried and screened prior to pressing. Those having ordinary skill in the art will be able to identify additional possible binders.

The addition of molybdenum powder promotes temperature resistance and enhances frictional properties of the resulting powder metal materials. If present, molybdenum powder preferably is included in the powders at levels of about 0.5 to about 15 weight percent, and more preferably at about 3 to about 10 weight percent. Less than 0.5 weight percent has been found to be generally ineffective in aiding high temperature wear resistance, while adding more than 15 weight percent molybdenum is a substantial expense and has been found to possibly alter thermal expansion of the part so that it does not approximate that of a conventional stainless steel EGR valve stem. Molybdenum at the 3–10 weight percent range better addresses cost and thermal expansion issues. An example of a molybdenum powder that may be used in the powders of the invention is Grade T290 powder, available from Osram-Sylvania, Towanda, Pa. Those of ordinary skill may readily identify other suitable molybdenum powders.

Molybdenum-containing powders may be used in combination with or in place of pure molybdenum powder to supply molybdenum to powder mixes for suitable applications. For example, ferro-molybdenum powder may be used in applications in which high corrosion resistance is unnecessary. Carbon and iron in ferro-molybdenum powders may detract from the corrosion resistance of any series 300 stainless steel powders in the powder mixes.

When nickel-base alloy powder is present in the powder mix, it preferably is used at a level of about 1 to about 15 weight percent. The inventor has determined that when the stainless steel in the powder is a 316L stainless steel powder, at least about 1 weight percent of nickel-base alloy powder should be used to sufficiently alter the wear properties of the composite material relative to the stainless steel of the valve stem itself. More than about 15 weight percent of nickel-base alloy powder may be uneconomical and may give the material unacceptable thermal expansion properties relative to conventional EGR system valve stem materials.

Suitable nickel-base alloy powders include nickel-base hardfacing alloy powders and nickel-base braze alloys. Nickel-base hardfacing alloys include compositions that are usually used to produce wear-resistant and corrosion-resistant surfaces on parts. A nickel-base hardfacing alloy surface may be laid down as a melt layer on the surface of a base metal or may be applied by thermal spraying onto a surface of a softer or less corrosion-resistant base metal. After coating, the layer is ground to tolerance. Hardfacing alloys usually show hardness of Rockwell C 30-60. The primary purpose of nickel-base braze alloy is to bond two separate parts together. The most important characteristics of braze alloys are melting point and wettability. Usually, alloy compositions are controlled to give lower melting points and to be compatible with the metals in the two parts being joined.

The broad compositions of nickel-base hardfacing alloy powders and nickel-base braze alloy powders are known to those of ordinary skill in the art. As is known in the art, there are several composition classes involved in the nickel-base hardfacing and nickel-base braze alloy categories. Typical compositional ranges for such materials include:

| Alloy Type | C | Cr | Si | Fe | B | W | Co | Ni | P |
|---|---|---|---|---|---|---|---|---|---|
| Nickel/ Boron | 0.15–0.18 | 5–19 | 3–5 | 1–5 | 2–4 | 0–16 | 0 | Bal. | — |
| Nickel/ Phos-phorus | 0.15 | 0–13 | — | — | — | — | — | Bal. | 10–12 |
| Nickel/ Cobalt/ Boron | 0.6–0.8 | 10–21 | 1–3 | 1–2 | 2–4 | 5–10 | 44–58 | Bal. | — |

Specific examples of suitable nickel-base hardfacing alloy powders include COLMONOY 21 and COLMONOY 53 alloy powders, available from Wall-Colmonoy, Madison Heights, Mich. Suitable nickel-base braze alloys include NICROBRAZE 150 (AWS4774) and NICROBRAZE 125 (AWS4775A), also available from Wall-Colmonoy. The following table provides the nominal compositions of these powders.

| Powder | Chromium | Boron | Silicon | Iron | Carbon | Nickel |
|---|---|---|---|---|---|---|
| COLMONOY 21 | 5 | 1.25 | 3.25 | 1.0 | 0.25 | Bal |
| COLMONOY 53 | 11.5 | 2.5 | 3.75 | 4.25 | 0.65 | Bal. |
| NICROBRAZE 150 | 15 | 3.5 | — | — | — | Bal. |
| NICROBRAZE 125 | 14 | 3 | 4.5 | 4.5 | 0.7 | Bal. |

When present, glass is included in the powder mixes of the present invention in an amount of about 0.5 to 15 weight percent. Less than about 0.5 weight percent has been found to produce little enhancement in performance. At high glass content levels, slumping or melting can result. The glass preferably is in a powder form for mixing with the stainless steel and/or low-chromium steel-base powders. Preferred glass particle sizes are—100 mesh with greater than 50%–325 mesh. Glass has been found to contribute one or more of wear resistance, corrosion resistance, and non-adherence to valve guide parts made from the glass-containing powders of the present invention. Glass also may provide a liquid phase during sintering which enhances the sintering step.

When glass additions are used, they must be compatible with the remaining ingredients in the powder mix. Examples of glasses that have been found useful in certain powder compositions within the present invention include borosilicate glasses, such as B—Si—Al—Mg and B—Si—Al—Na glasses, and phosphate glasses. Examples of phosphate glasses that may be used in the present invention include those having about 9 up to about 15 weight percent phosphorus, based on the total glass weight, and significant aluminum, sodium, and boron contents. However, it will be understood that the present invention is not limited to the use of such phosphate glasses. For example, it is believed that phosphate glasses having a phosphorus content outside the 9–15 weight percent range also may be used. Particular B—Si—Al—Mg, B—Si—Al—Na and phosphate glasses that have proven useful include those in the following table, with contents shown in weight percentages. These glasses are available from Ferro Corp., Cleveland, Ohio, or Corning Glass, Corning, N.Y., as indicated.

| Source | B | Si | Al | Mg | Ca | Na | K | P | O |
|---|---|---|---|---|---|---|---|---|---|
| Ferro | 10 | 24 | 8 | — | 0.3 | 10 | 2.8 | — | Bal. |
| Ferro | 2.5 | — | 12 | — | — | 8 | 8 | 9 | Bal. |
| Ferro | 8 | 35 | 8 | — | — | 3 | — | — | Bal. |
| Corning | 8 | 35 | 2.5 | — | — | 5 | — | — | Bal. |

Conventional powder metal processing techniques may be used to form parts from powders within the present invention. Press-ready powder is placed in a mold and pressed, typically at about 20 to about 70 tsi, and preferably at about 20 tsi to about 40 tsi to limit die wear. The green compact is sintered at about 2050° F. (1121° C.) to about 2350° F. (1288° C.) in a protective atmosphere to produce a part having suitable mechanical, thermal and frictional properties. After sintering, parts may be sized and lubricated to improve dimensional control and facilitate break-in, although such additional treatment will be unnecessary in certain applications. When used in the production of materials for EGR valve guide applications, a lubricating step aids in reducing part wear during use.

Two methods of sizing and lubricating sintered parts have provided material made by the methods of the present invention with enhanced frictional properties, although it is contemplated that other methods may be used. In a first method, sintered compacts are sized. The sized compacts are then impregnated with a suspension including a solid lubricant in a liquid carrier. The impregnated compacts are then heated to substantially remove the carrier from the compact and to provide a deposit of the solid lubricant on the compact. The lubricant may be, for example, molybdenum disulfide, and the carrier may be, for example, oil, water, or mineral spirits.

In a second method, the sintered compacts are coated and/or impregnated with a suspension including at least one solid lubricant in a liquid carrier. The compacts are then heated to substantially remove the carrier from the compact and provide a deposit of the solid lubricant on the compact. The lubricated compacts are subsequently sized. The lubricant may be, for example, molybdenum disulfide, and the carrier may be, for example, oil, water, or mineral spirits. The lubricant provides a film on the surface of the part that can serve as a sizing lubricant, and this may eliminate or reduce the need for a separate sizing lubricant. When a part treated in this way is sized, the lubricant is, to some extent, forced into surface depressions in the compact and is tightly adhered to the surface.

When powder metal parts are processed by conventional mold-sinter or mold-sinter-size sequences, they typically exhibit densities of 75–92 percent theoretical. Thus, there is typically residual porosity in these parts of 8–25 percent. Most of this porosity is open to the surface. It is therefore possible to backfill the porosity with liquids by, for example, drawing a vacuum on the parts, immersing them in a liquid and re-admitting atmosphere to the vessel. The pressure of the air or gas forces the liquid into the porosity. If very fine, colloidal solids are suspended in the liquid, such as, for example, molybdenum disulfide in oil, the solid particles also penetrate into the porosity. Thus, in "impregnation", particles are not confined to the surface but can penetrate into the part. In contrast, "coating" is a surface phenomenon and would not conventionally involve vacuum. The colloidal suspension is merely dipped, sprayed, or otherwise coated onto the part. The solid in the suspension is substantially confined to the surface and typically does not enter the interior pores to any significant degree. When the part is dried, the liquid is evaporated to the atmosphere leaving behind the solid. In the case of impregnation, some of the solid within the pores of the part may migrate to the surface with the liquid if the liquid is being boiled off. If removal is performed below the boiling point, very little internal colloidal material would come to the surface. Following impregnation, it is preferred to remove the liquid rapidly to assure a deposit of the solid lubricant on the part surface, where it provides lubrication for the sizing operation along with any surface solids deposited during impregnation. In the case of coating, it is preferred to remove the carrier liquid of the colloid (for example, water or mineral spirits) slowly to leave behind a thin film of solid lubricant bonded to the surface only. The surface film acts as a lubricant for the sizing operation. In both cases, drying time and temperature are selected to remove essentially all of the carrier liquid.

More specific examples of the sizing and lubricating techniques of the present invention are as follows. In one such technique, a sintered part is sized, preferably at about 30 to about 50 tsi, and is then impregnated with a suspension of a solid lubricant in oil. A preferred solid lubricant is molybdenum disulfide. The part is then fired in a protective atmosphere, preferably at about 800° F. (427° C.) to about 1400° F. (760° C.), to remove the oil and leave behind a fine deposit of the solid lubricant. In a second more specific example, the "as sintered" part is impregnated with a suspension of solid lubricant in oil. The part is then fired, preferably at about 1200° F. (649° C.), to remove the oil and produce a fine film of solid lubricant on the surface. The part is then sized, preferably at about 30 to about 50 tsi, so that the film is sized into the surface of the part.

In another sequence within the present invention, the sintered part is dip coated in a water-base suspension of a solid lubricant, such as molybdenum disulfide, and is then dried at elevated temperature. The part may then be sized in a conventional manner. A more specific example of a coating-drying-sizing sequence is as follows. A sintered part dip coated in a water-base molybdenum disulfide suspension is heated for about 2 to about 6 hours at 175° F. (65° C.). A suspension of molybdenum disulfide in mineral spirits also could be used and may be air-dried or dried for a shorter time and/or at lower temperatures. The part is then sized, preferably at about 30 to about 50 tsi.

It will be understood that the above-described techniques for lubricating and sizing parts produced by the method of the present invention are non-limiting examples and that other techniques for part lubrication and/or sizing may be used. For example, a lubricant, such as molybdenum disulfide, may be added to the powder mix prior to molding. In that way, it may be possible to eliminate the impregnation step and the step of heating the compact to remove a carrier.

Examples of commercially available molybdenum disulfide suspensions include MOLYDAG 200 (molybdenum disulfide in oil), MOLYDAG 206 (molybdenum disulfide in water), and MOLYDAG 214 (molybdenum disulfide in mineral spirits), all available from Acheson Colloids, Port Huron, Mich.

Following are actual examples of methods and materials within the present invention. In addition, a 316L stainless steel/20 weight percent Triballoy composite is provided as Example 1 for comparative purposes.

EXAMPLE 1

A powder mix including 316L stainless steel powder and 20 weight percent Triballoy 400 powder was molded at about 40 tsi into the shape of a cylindrical valve guide and sintered for 30 minutes at about 2180° F. (1193° C.) in a 75 volume percent hydrogen/25 volume percent nitrogen atmosphere. The part was then sized at about 45 tsi. The part was run on the testing equipment shown schematically in FIG. 2 as described above. As noted, the testing cycle consisted of running for 30 minutes at about 1200° F. (649° C.), cooling the part to less than 200° F. (93° C.), and re-starting and running for an additional 15 minutes at about 1200° F. (649° C.). The usual clearance between the reciprocating rod and the test specimen was about 0.0052 inch (0.132 mm). The surface finish of the reciprocating rod after testing parts made as described in this example was about 40 Ra.

EXAMPLE 2

Test parts were formed from a dry blend of 90 weight percent 316L stainless steel powder, 10 weight percent molybdenum powder, and 0.75 weight percent ACRAWAX EBS powder. The convention used in this and the remaining examples is to ignore molding lubricant content in the powder mix when calculating weight percentages of the remaining powder ingredients. This was done because molding lubricant is lost during sintering and does not contribute to weight percentages after sintering.

Test specimens approximating the form of cylindrical valve guides were prepared by molding portions of the powder mix at 35 tsi, sintering the green compacts for 30 minutes at 2180° F. (1193° C.) in a 75 volume percent hydrogen/25 weight percent nitrogen atmosphere, and then sizing the sintered parts at 45 tsi. The parts were then impregnated with MOLYDAG 200 molybdenum disulfide/oil suspension by drawing a vacuum on the parts, immersing them in the suspension, and re-admitting the atmosphere. The parts were subsequently heated in a nitrogen atmosphere at 1200° F. (649° C.) to remove the oil.

Specimens of the material were run on the testing equipment using the same process and typical rod/part clearance as described in Example 1. One mode of failure that may occur during testing is adhesion or "seizing" between the reciprocating rod and the test valve guide part. Seizing indicates excessive wear and/or excessive temperatures between the rod and valve guide. No seizing was observed during testing of parts made in this example. The surface roughness of the rod was less than Ra 5 at the beginning of the run and was Ra 70 after the run.

EXAMPLE 3

A powder mix was prepared by dry blending 93 weight percent 316L stainless steel powder, 5 weight percent molybdenum powder, 2 weight percent phosphate glass powder, and 0.75 weight percent ACRAWAX EBS powder. Parts were molded, sintered, sized, impregnated with lubricant, and re-sintered as in Example 2. No seizing was observed during testing performed as in Example 1. The final surface finish of the rod was Ra 80.

EXAMPLE 4

A portion of the glass-containing powder mix of Example 3 was molded and sintered as described in that example. The sintered part was impregnated with MOLYDAG 206 molybdenum disulfide/water suspension and then dried at 175° F. (79° C.) for 6 hours to remove the water and provide a lubricant deposit on the part. The part was subsequently sized at about 45 tsi and tested as in Example 1. The part did not seize during the test, and the rod showed a surface finish of Ra 45 after the test. Several additional parts made in the same way were tested, and the reciprocating rods exhibited surface roughness of Ra 25–55 after the testing.

EXAMPLE 5

A dry powder mix was produced from 90 weight percent 316L stainless steel powder, 10 weight percent NICROBRAZE 150 powder, and 0.75 weight percent ACRAWAX EBS powder. The mix was processed as in Example 2. No seizing occurred during testing as in Example 1. The final surface finish of the rod after testing was Ra 70.

EXAMPLE 6

A blend of 95 weight percent 316L stainless steel and 5 weight percent phosphate glass powder was wet mixed with 1% acrylic binder (ELVACITE 2010) in an acetone solution. The mix was dried and screened, and 0.2 weight percent ACRAWAX EBS powder was then added to facilitate molding. Parts were processed as in Example 2 and tested as in Example 1. The material did not seize during testing, and the final surface finish of the rod was Ra 30.

EXAMPLE 7

A mix of 316L stainless steel powder and 5 weight percent borosilicate glass was prepared using a binder as in Example 6. The mix was processed as in Example 6 and tested as in Example 1. No seizing occurred, and the final surface finish of the rod was Ra 75.

EXAMPLE 8

A mix as described in Example 3 was molded at 35 tsi and sintered at 2180° F. (1193° C.) in a 75 volume percent hydrogen/25 volume percent nitrogen atmosphere. The sintered part was then impregnated with a suspension of molybdenum disulfide in oil and reheated to about 1200° F. (649° C.). This reheating step drove off the oil and left a molybdenum disulfide deposit on the part surface. The part was then sized at 45 tsi and tested as in Example 1. No seizure occurred between the rod and the experimental part. The stainless rod showed a surface finish of Ra 20 after the test.

EXAMPLE 9

A mix including 93 weight percent 316L stainless steel powder, 7 weight percent phosphate glass, and a binder was prepared as in Example 6, molded at 35 tsi, sintered at about 2180° F. (1193° C.) in a 75 volume percent hydrogen/25 volume percent nitrogen atmosphere, and sized at 45 tsi. The part was then subjected to testing as in Example 1 with no supplemental lubrication. No seizure occurred. The surface roughness of the rod after testing was Ra 25.

EXAMPLE 10

It is desirable to minimize the gap between the valve stem and the valve guide of EGR systems in order to minimize the leakage of gases through the gap. Accordingly, testing was run on the test equipment described above with an approximately 0.0040 inch (0.102 mm) gap rather than the usual 0.0052 inch (0.132 mm) gap. Two materials were tested using the narrower gap, the 316L-20% Triballoy material of Example 1 and the 316L-5% Mo-2% glass material of Example 3. The 316L/Triballoy material seized during testing. The glass-containing material survived the testing, and the rod showed a surface roughness of Ra 40 after testing.

EXAMPLE 11

A powder mix including 89 weight percent 316L stainless steel powder, 5 weight percent molybdenum, 2 weight percent phosphate glass, and 4 weight percent molybdenum disulfide was prepared. 1 weight percent of a solution of ELVACITE 2010 in acetone was used as a binder, and 0.2 weight percent ACRAWAX EBS as a lubricant. The powder mix was molded at 30–40 tsi, sintered at 2100–2200° F. (1148–1204° C.) in a 75 volume percent hydrogen/25 volume percent nitrogen atmosphere, and sized at 40–50 tsi. No seizure occurred during testing, and the rod surface finish after testing was Ra 65.

The following table provides the final rod surface finish for tests using parts produced in the above examples. For further comparison, the table also lists final rod surface finish values for testing under identical conditions of valve guide parts produced by the method of Example 1 from mixes including standard 316L stainless steel powder and one of 20 weight percent M3 tool steel powder and 20 weight percent ferrochrome powder.

| Base Powder | Powder Additives | Part Production Method | Rod Surface Ra |
|---|---|---|---|
| 316L | 20% Triballoy | Mold-sinter-size (Example 1) | 40 |
| 316L | 10% molybdenum | Mold-sinter-size-impregnate-dry (Example 2) | 70 |
| 316L | 5% molybdenum, 2% phosphate glass | Mold-sinter-size-impregnate-dry (Example 3) | 80 |

-continued

| Base Powder | Powder Additives | Part Production Method | Rod Surface Ra |
|---|---|---|---|
| 316L | 5% molybdenum, 2% phosphate glass | Mold-sinter-impregnate-dry-size (Example 4) | 25-55 |
| 316L | 10% Nicrobraze 150 | Mold-sinter-size-impregnate-dry (Example 5) | 70 |
| 316L | 5% phosphate glass | Mold-sinter-size-impregnate-dry (Example 6) | 30 |
| 316L | 5% BSiAlNa glass | Mold-sinter-size-impregnate-dry (Example 7) | 85 |
| 316L | 5% molybdenum, 2% phosphate glass | Mold-sinter-impregnate-dry-size (Example 8) | 20 |
| 316L | 7% phosphate glass | Mold-sinter-size (Example 9) | 25 |
| 316L | 5% molybdenum, 2% phosphate glass | Mold-sinter-size (Example 11) | 65 |
| 316L | 20% M3 tool steel | Mold-impregnate with molybdenum disulfide-dry at 1200° F. (649° C.) | 210 |
| 316L | 20% Ferrochrome | Mold-sinter-size-impregnate with molybdenum disulfide-dry at 1200° F. (649° C.) | 100 |

It will be seen from the table that stainless steel rods from test runs using valve guides formed of materials within the present invention had surface roughness less than Ra 100. Those surface roughness values compared favorably with values determined for a conventional composite produced from a powder including 316L stainless steel and 20 weight percent Triballoy. The surface roughness values derived from the testing of the materials including Ferrochrome and M3 tool steel were at least as great as Ra 100.

Accordingly, it will be understood that the present invention includes materials that may be formed by the methods encompassed by the present invention. One material within the present invention is a powder metal material including a matrix of at least one of stainless steel and low-chromium steel, and 0.5 to 15 weight percent glass particles suspended in the matrix, wherein the weight percentage is based on the total weight of the material. The material also may include, for example, 0.5 up to 15 weight percent molybdenum, based on the total weight of the material, and at least a portion of the molybdenum is present in the matrix. More specific examples of materials that may be formed by the methods of the present invention include the following.

Stainless Steel/Phosphate Glass Composites

Figure 3:
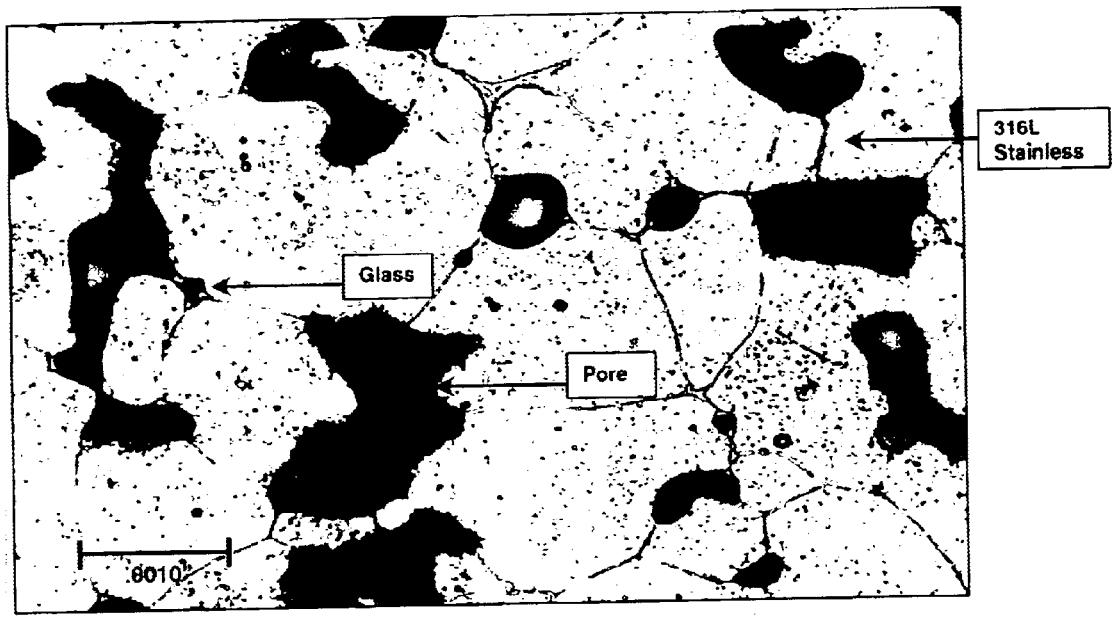
FIGS. 3–6 are photomicrographs of materials formed by methods within the present invention.

Examples 6 and 9 above are embodiments of the method of the present invention forming composites of 316L stainless steel and phosphate glass. FIG. 3 is a photomicrograph of one such sintered composition showing a 316L stainless steel matrix with random phosphorous-rich glass dispersions. Regions of the matrix and the glass dispersion, and a pore in the material, are labeled in the figure. It also appears that chromium and molybdenum diffused into the liquid glass phase to produce a chromium-molybdenum-phosphorus composition. The matrix micro-hardness was measured to be Rockwell C 23, which indicates that a small amount of phosphorus may have dissolved in the stainless steel to increase its hardness versus a pure 316L stainless steel. The glassy areas were too small to be evaluated for micro-hardness, but it is suspected that they were harder than the matrix. It is believed that the stainless steel/phosphorus glass microstructure contributed to anti-seizure and favorable wear properties in the EGR testing.

Stainless Steel/Molybdenum Composites

Figure 4:
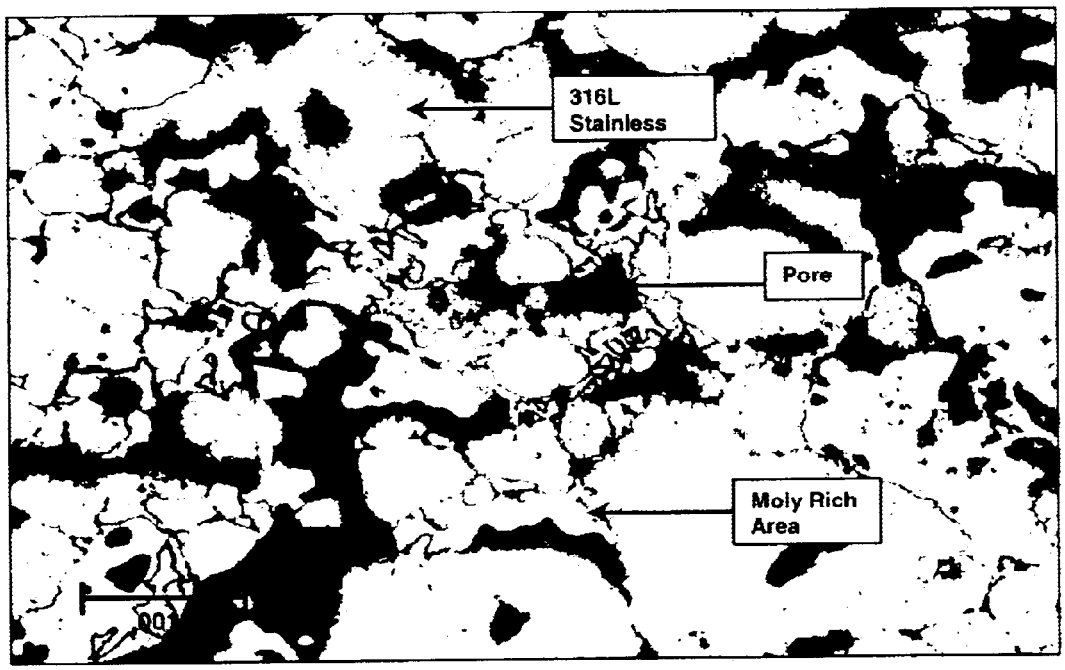

A material including 316L stainless steel and 10 weight percent molybdenum is one material within this system. That material was produced in Example 2 above. A photomicrograph of material produced in that example, attached as FIG. 4, shows a 316L stainless steel matrix with random, white dispersions of molybdenum-rich areas. Regions of the matrix and molybdenum-rich dispersion, and a pore in the material, are labeled in the figure. The final total composition of the material was about 15 weight percent chromium, about 12 weight percent nickel, about 12 weight percent molybdenum, and balance iron. Some molybdenum diffused into the matrix (in weight percent, about 13 chromium, about 10 nickel, about 13 molybdenum, balance iron) and a significant amount of chromium diffused into the molybdenum phase (about 40 molybdenum and about 10 chromium) to provide a two-phase structure which exhibits favorable wear and anti-seizure properties in EGR conditions. The matrix hardness was Rockwell C 9, so it appears that the molybdenum did not contribute significantly to hardness. The hardness of the molybdenum-rich phase could not be measured.

Stainless Steel/Nickel Brazing Alloy Composites

Figure 5:
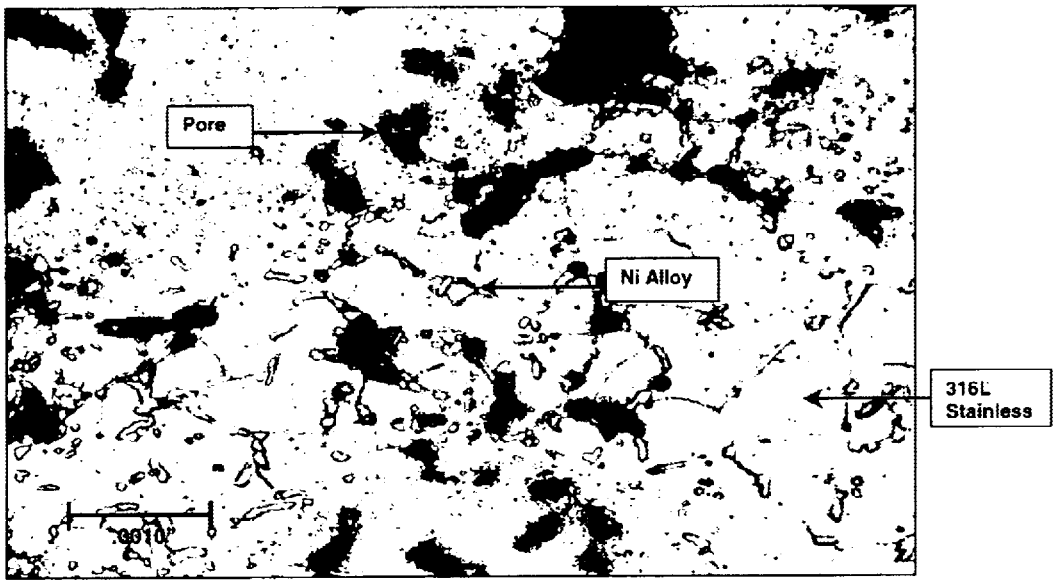

A material including 90 weight percent 316L stainless steel and 10 weight percent Nicrobraze 150 nickel-base brazing alloy was produced in Example 5 above. The microstructure of that material, shown in FIG. 5, consists of a 316L stainless steel matrix with small, random dispersions of white etching particles, primarily at the grain boundaries. Regions of the matrix and dispersion, and a pore in the material, are labeled in the figure. The final composition of this material, in weight percentages, was approximately 15 chromium, 12.5 nickel, 2.5 molybdenum, 0.35 boron, and balance iron. The dispersed particles were rich in chromium and molybdenum. Without intending to be bound to any particular theory, it is hypothesized that the liquid nickel alloy dissolved chromium and molybdenum from the 316L stainless steel matrix and concentrated these elements in the dispersed phase, thereby enhancing wear resistance. The areas immediately surrounding the larger pores were rich in nickel, which is some evidence that the nickel alloy melted and was alloyed with the matrix surrounding it. Hardness of the area around the pores was about Rockwell B 80. The hardness of the small white particles could not be measured, but would be expected to be significantly harder than the matrix. The mixture of hard and soft areas is believed to contribute to the anti-seizure properties and good wear resistance of the material.

Stainless Steel/Molybdenum/Glass Composites

Figure 6:
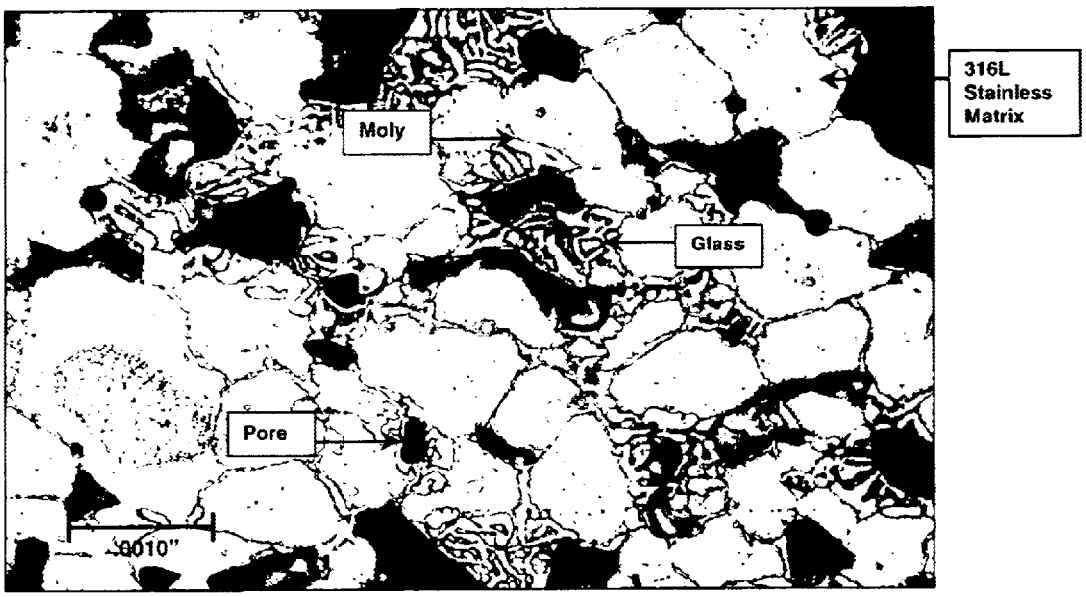

One material within this family, a composite of 316L stainless steel, 5 weight percent molybdenum, and 2 weight percent phosphate glass was prepared in Examples 3, 4, and 8 above. The microstructure of the material is shown in FIG. 6 and is characterized by a 316L stainless steel matrix with a lacy deposit in the grain boundaries. Regions of the matrix, glass, and deposit, and a pore in the material, are labeled in the figure. The final composition of this material, in weight percentages, was approximately 16 chromium, 12 nickel, 7 molybdenum, 0.1 phosphorus, and balance iron. The dispersion was rich in phosphorus and molybdenum, and some molybdenum diffused into the matrix. The dispersion, at Rockwell C 42, was hard relative to the matrix, which was about Rockwell B 88. It is believed that the dispersion in the softer matrix improved high-temperature wear properties and prevented seizing.

An alternative to the method used in examples 3, 4, and 8 for preparing a stainless steel/molybdenum/glass composite material is provided in Example 11 above. The microstructure of the material was similar to that shown in FIG. 6, but with molybdenum disulfide particles in some of the pores.

Tested materials within the present invention may be lower in cost than conventional stainless steel/Triballoy material. Tested materials within the present invention also may exhibit corrosion resistance superior to the tested materials formed from powders including tool steel powder or ferrochrome powder. Coefficient of thermal expansion (CTE) testing indicated only a slight decrease in CTE for the tested glass-containing materials of the present invention relative to sintered 316L stainless steel material. For example, the following CTE data for sintered powder metal materials was obtained using a Theta dilatometer and measured from room temperature up to 400° C.

| Material | Density (g/cc) | CTE ($\times 10^{-6}$/° C.) |
|---|---|---|
| 316L | 6.6 | 22.4 |
| 316L-Triballoy | 6.4 | 22.0 |
| 316L-5Mo-2 Glass | 6.1 | 21.8 |

As is evident from the above description of the present invention, embodiments of materials within the present invention are suitable for use as valve guides in EGR systems for internal combustion engines. It will be understood, however, that the present invention is not so limited and that the materials of the present invention may be used in other applications. Examples of such applications include valve seats, exhaust system components, combustion chambers, other combustion engine parts subjected to high temperature (for example, 800–1600° F. (427–871° C.), and chemical industry valve and corrosion parts.

Whereas particular embodiments of the invention have been described herein for the purpose of illustrating the invention and not for the purpose of limiting the same, it will be appreciated by those of ordinary skill in the art that numerous variations of the details, materials, and arrangement of steps and ingredients may be made within the principle and scope of the invention without departing from the invention as described in the appended claims.

What is claimed is:

1. A method of forming a powder metal article, the method comprising:

molding a compact from a metallurgical powder comprising at least one of a stainless steel powder and a low-chromium steel-base powder, and about 0.5 to about 15 weight percent glass powder;

sintering the compact; and lubricating the sintered compact by at least one of coating and impregnating the sintered compact with a suspension including a solid lubricant in a carrier.

2. The method of claim 1, wherein the metallurgical powder predominantly consists of the sum of the weights of stainless steel powder and low-chromium steel-base powder within the metallurgical powder.

3. The method of claim 1, wherein the metallurgical powder further comprises about 0.5 to about 15 weight percent molybdenum.

4. The method of claim 1, wherein the metallurgical powder further comprises about 3 to about 10 weight percent molybdenum.

5. The method of claim 1, wherein the metallurgical powder is predominantly stainless steel powder.

6. The method of claim 1, wherein the metallurgical powder includes an austenitic stainless steel powder.

7. The method of claim 1, wherein the metallurgical powder includes at least one powder selected from the group consisting of 316L stainless steel powder and 410L stainless steel powder.

8. The method of claim 1, wherein the glass is at least one glass selected from borosilicate glass and phosphate glass.

9. The method of claim 1, further comprising:

sizing the sintered compact prior to lubricating the sintered compact; and heating the sintered compact subsequent to lubricating the sintered compact to substantially remove the carrier from the sintered compact and provide a deposit of the solid lubricant on the sintered compact.

10. The method of claim 1, wherein the suspension including the solid lubricant in the liquid carrier comprises molybdenum disulfide in an oil, the method further comprising:

sizing the sintered compact at about 30 tsi to about 50 tsi prior to lubricating the sintered compact; and heating the sintered compact at about 800° F. to about 1400° F. subsequent to lubricating the sintered compact to substantially remove the oil and provide a deposit of molybdenum disulfide on the sintered compact.

11. The method of claim 1, further comprising:

at least one of drying the suspension on a surface of the sintered compact and drying the suspension in at least one pore of the sintered compact; and sizing the sintered compact.

12. The method of claim 1, wherein the solid lubricant comprises molybdenum disulfide and the liquid carrier is selected from the group consisting of oil, water, and mineral spirits, the method further comprising:

at least one of drying the suspension on a surface of the sintered compact and drying the suspension in at least one pore of the sintered compact by heating the sintered compact; and sizing the sintered compact at about 30 to about 50 tsi.

13. The method of claim 1, wherein the article is a valve guide for an EGR system for an internal combustion engine.

14. A metallurgical powder comprising:

at least one stainless steel powder selected from the group consisting of 316L stainless steel powder and 304L stainless steel powder;

about 0.5 to about 15 weight percent molybdenum; and about 0.5 to about 15 weight percent glass powder.

15. The metallurgical powder of claim 14, comprising about 3 to about 10 weight percent molybdenum.

16. The metallurgical powder of claim 14, wherein the glass is at least one glass selected from the group consisting of borosilicate glass and phosphate glass.

17. A powder metal article made by a method comprising:

molding a compact from a metallurgical powder including at least one of a stainless steel powder and a low-chromium steel-base powder, and about 0.5 to about 15 weight percent glass powder;

sintering the compact; and lubricating the sintered compact by at least one of coating and impregnating the sintered compact with a suspension including a solid lubricant in a liquid carrier.

18. The powder metal article of claim 17, wherein the metallurgical powder predominantly consists of the sum of the weights of stainless steel powder and low-chromium steel-base powder within the metallurgical powder.

19. The powder metal article of claim 17, wherein the metallurgical powder further comprises about 3 to about 15 weight percent molybdenum.

20. The powder metal article of claim 17, wherein the article is a valve guide for an EGR system of an internal combustion engine.

21. A powder metal article comprising:

0.5 to 15 weight percent of glass particles dispersed in a matrix including at least one stainless steel selected from the group consisting of 316L stainless steel and 304L stainless steel; and about 0.5 to about 15 weight percent molybdenum in the matrix.

22. A powder metal material comprising:

a matrix including at least one austenitic stainless steel selected from the group consisting of 316L stainless steel and 304L stainless steel;

0.5 up to 15 weight percent molybdenum, based on the total weight of the material, at least a portion of the molybdenum present in the matrix; and 0.5 up to 15 weight percent glass particles suspended in the matrix, based on the total weight of the material.

23. The powder metal material of claim 22, wherein the glass particles are composed of a material selected from the group consisting of phosphate glass and borosilicate glass.

24. A powder metal material comprising:

a matrix including at least one austenitic stainless steel selected from the group consisting of 316L stainless steel and 304L stainless steel;

a low-chromium steel comprising 1 up to 5 weight percent chromium, based on the total weight of the material; and 0.5 up to 15 weight percent glass particles suspended in the matrix, based on the total weight of the material.

25. The metallurgical powder of claim 14, wherein the metallurgical powder comprises more than 50 weight percent of stainless steel powder.

26. A method of forming a powder metal article, the method comprising:

molding a compact from a metallurgical powder comprising at least one of a stainless steel powder and a low-chromium steel-base powder, and about 0.5 to about 15 weight percent glass powder;

sintering the compact;

at least one of coating and impregnating the sintered compact with a suspension including a solid lubricant in a liquid carrier;

at least one of drying the suspension on a surface of the sintered compact and drying the suspension in at least one pore of the sintered compact; and sizing the sintered compact.

27. A method of forming a powder metal article, the method comprising:

molding a compact from a metallurgical powder comprising at least one of a stainless steel powder and a low-chromium steel-base powder, molybdenum disulfide, and about 0.5 to about 15 weight percent glass powder and sintering the compact.

28. A metallurgical powder comprising:

at least one of a stainless steel powder and a low-chromium steel-base powder;

molybdenum disulfide; and about 0.5 to about 15 weight percent glass powder.

29. A powder metal material comprising:

a matrix including at least one of a stainless steel powder and a low-chromium steel-base powder;

molybdenum disulfide; and 0.5 up to 15 weight percent glass particles suspended in the matrix, based on the total weight of the material.

30. A method of forming a powder metal article, the method comprising:

molding a compact from a metallurgical powder comprising a 300 series stainless steel powder, about 0.5 to about 15 weight percent molybdenum, and 0.5 to 15 weight percent glass powder; and sintering the compact.

31. The method of claim 30, wherein the metallurgical powder comprises at least one stainless steel powder selected from the group consisting of 316L stainless steel powder and 304L stainless steel powder.

32. A method of forming a powder metal article, the method comprising:

molding a compact from a metallurgical powder comprising a 300 series stainless steel powder, a low-chromium steel-base powder and 0.5 to 15 weight percent glass powder; and sintering the compact.

33. The method of claim 30, wherein the metallurgical powder comprises about 3 to about 10 weight percent molybdenum.

34. The method of claim 30, wherein the metallurgical powder is predominantly stainless steel powder.

35. The method of claim 30, wherein the glass is at least one glass selected from borosilicate glass and phosphate glass.

36. A method of forming a powder metal article, the method comprising:

molding a compact from a metallurgical powder comprising a 300 series stainless steel powder and 0.5 to 15 weight percent glass powder;

sintering the compact;

sizing the sintered compact;

impregnating the sintered compact with a suspension including a solid lubricant in a liquid carrier; and heating the sintered compact to substantially remove the carrier from the sintered compact and provide a deposit of the solid lubricant on the sintered compact.

37. The method of claim 36, wherein:

sizing the sintered compact comprises sizing the sintered compact at about 30 tsi to about 50 tsi;

the suspension comprises molybdenum disulfide in an oil; and heating the sintered compact at about 800° F. to about 1400° F. to substantially remove the oil and provide a deposit of molybdenum disulfide on the sintered compact.

38. A method of forming a powder metal article, the method comprising:

molding a compact from a metallurgical powder comprising a 300 series stainless steel powder and 0.5 to 15 weight percent glass powder;

at least one of coating and impregnating the sintered compact with a suspension including a solid lubricant in a liquid carrier;

at least one of drying the suspension on a surface of the sintered compact and drying the suspension in at least one pore of the sintered compact; and sizing the sintered compact.

39. The method of claim 38, wherein the solid lubricant is molybdenum disulfide, the liquid carrier is selected from the group consisting of oil, water, and mineral spirits, and the sintered compact is sized at about 30 to about 50 tsi.

40. A metallurgical powder comprising:

a 316L stainless steel powder;

from 0.5 to 5 weight percent molybdenum powder; and from 2 to 7 weight percent glass powder.

41. A metallurgical powder comprising:

a low-chromium steel-base powder;

from 0.5 to 15 weight percent molybdenum powder; and from 0.5 to 15 weight percent glass powder.

42. A metallurgical powder comprising:

a low-chromium steel-base powder;

from 1 to 15 weight percent of a nickel-based alloy powder; and from 0.5 to 15 weight percent glass powder.

43. A powder metal material comprising:

a matrix including at least one 300 series stainless steel;

0.5 up to 15 weight percent molybdenum, based on the total weight of the material, at least a portion of the molybdenum present in the matrix; and 0.5 up to 15 weight percent glass particles suspended in the matrix, based on the total weight of the material.

44. A powder metal material comprising:

a matrix including at least one 300 series stainless steel;

a low-chromium steel comprising 1 up to 5 weight percent chromium, based on the total weight of the material; and 0.5 up to 15 weight percent glass particles suspended in the matrix, based on the total weight of the material.

45. The method of claim 1 wherein the solid lubricant is molybdenum disulfide and the carrier is selected from the group consisting of oil, water, and mineral spirits.

46. The method of claim 27 further comprising sizing the sintered compact.

* * * * *

UNITED STATES PATENT AND TRADEMARK OFFICE

CERTIFICATE OF CORRECTION

PATENT NO. : 6,793,705 B2
DATED : September 21, 2004
INVENTOR(S) : John C. Kosco It is certified that error appears in the above-identified patent and that said Letters Patent is hereby corrected as shown below:

Column 18,
Line 17, insert a semi-colon -- ; -- between the word “powder” and the word “and”.

Signed and Sealed this

Nineteenth Day of April, 2005

JON W. DUDAS
*Director of the United States Patent and Trademark Office*